United States Patent [19]

Catelli

[11] 4,044,931

[45] Aug. 30, 1977

[54] TUBULAR BACK SUPPORTED CHILD CARRIER

[76] Inventor: Pietro Catelli, Via Vittorio Emanuele, 112, Como, Italy, 24100

[21] Appl. No.: 546,668

[22] Filed: Feb. 3, 1975

[30] Foreign Application Priority Data

July 16, 1974 Italy ..... 25210/74

[51] Int. Cl.[2] ..... A45F 3/08; A47D 1/02

[52] U.S. Cl. ..... 224/6; 224/25 A; 297/55

[58] Field of Search ..... 224/6, 25 A, 5 R, 25 R; 297/377, 55, 58; 403/84, 94; 280/641, 642, 644

[56] References Cited

U.S. PATENT DOCUMENTS

| | | | |
|---|---|---|---|
| 3,272,556 | 9/1966 | Rocker | 297/377 X |
| 3,421,670 | 1/1969 | Hansson | 224/6 |
| 3,713,568 | 1/1973 | Sloan | 224/6 |

*Primary Examiner*—L. J. Paperner
*Assistant Examiner*—Jerold M. Forsberg

[57] ABSTRACT

The tubular support particularly for child carriers consists of a resilient connection box made of plastics material, of two legs rigidly connected to the said connection box and of two U-profiled tubular frames able to present a folded and unfolded position, the folded position of a U-profiled tubular frame being locked by lock means and the folded and the unfolded position of the other U-profiled tubular frame being polarized by said resilient connection box.

1 Claim, 8 Drawing Figures

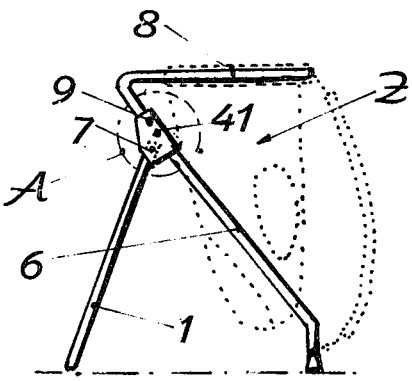
Fig.2
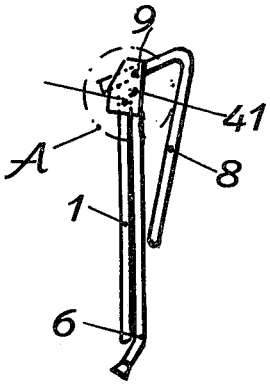
Fig.3
Fig.1
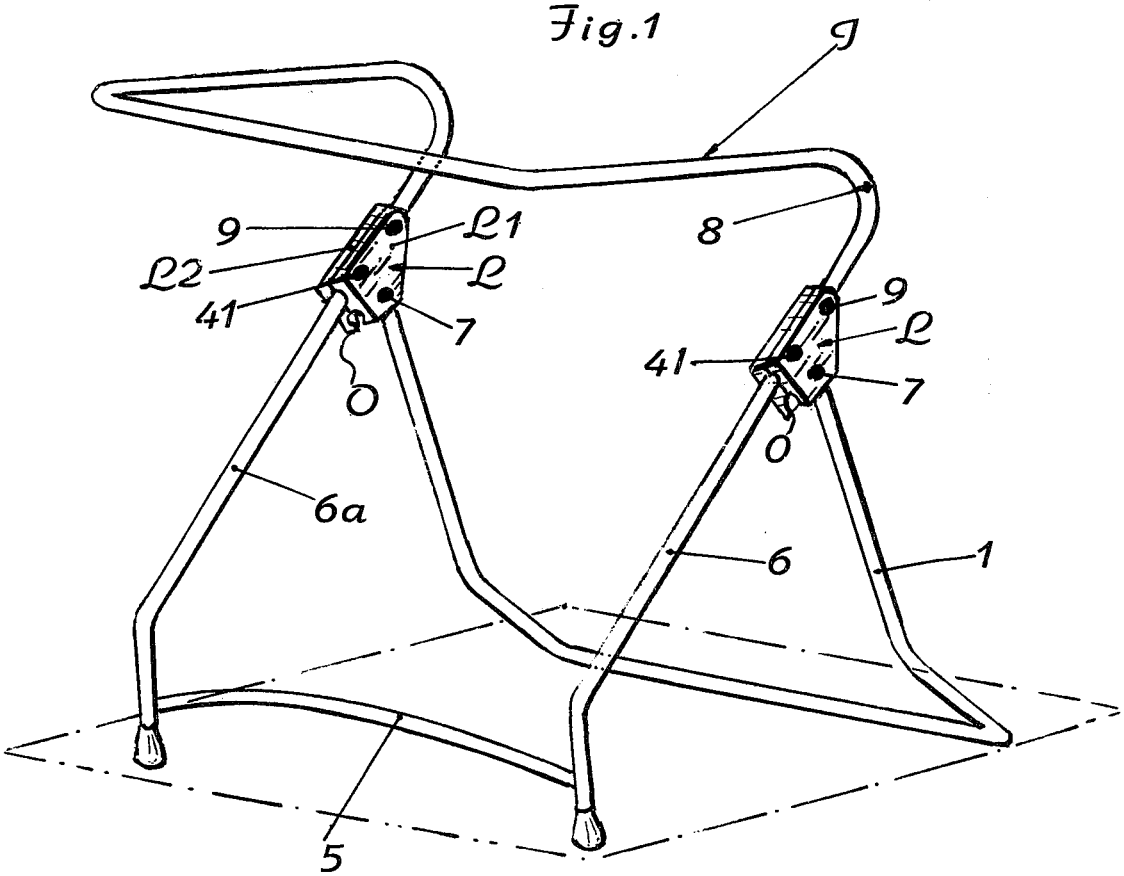

TUBULAR BACK SUPPORTED CHILD CARRIER

BACKGROUND OF THE INVENTION

A number of back supported child carriers are known in the art that generally present the drawback of a relatively hard handling. Another drawback resides in the fact that the operation is not satisfactory, so far concerns the comfort and doesn't comply with the requested safety for the baby particularly with regard the fastening means.

An object of the present invention resides in the elimination of the above drawbacks and in providing a foldable tubular back supported child carrier that may take when folded minimal overall dimensions as required in view of the well known lack of houses and for packing and shipping.

SUMMARY OF THE INVENTION

The tubular back supported child carrier according to this invention wherein provision is made for a tubular back supported child carrier comprising in combination for each side of the carrier a resilient connection box made of plastics material and including two symmetric flanges, two tubular legs firmly fastened by and located between the said two symmetric flanges of the said box, a upper and a lower U-profiled tubular frame pivotally mounted between the said flanges of the said box so as to be manually displaced in a folded and in an unfolded position, a child supporting bag shaped means fastened between the said upper frame and the said legs, means for supporting the child carrier on a person's back, the said tubular legs being stiffened by a metallic stem operating as a strut, the said upper frame including two terminal portions, resilient detents cooperating with the said terminal portions of the said upper frame so as to removably fasten the upper frame in the unfolded position and when released to to provide foldability of the upper frame against the said legs, each flange of the said box being formed with two intersecting grooves of profile complementary respectively to the section of the said upper and lower frame, the portion of the box comprised between the said intersecting grooves being profiled as profiled intersecting planes, whereby during the passage from the said folded to the said unfolded position and viceversa, the said flanges are elastically diverged from one another and thereafter cause a positive elastically contrained location of the said lower frame in said folded respectively unfolded position, the upper frame and the lower frame folding away from the said legs when the carrier is used as a baby chair and the upper frame and the lower frame folding against the said legs when the carrier is stored the upper frame folding from the legs and the lower frame folding against the legs when the carrier is used as a baby pack.

BRIEF DESCRIPTION OF THE DRAWINGS

FIG. 1 is a perspective representation of a tubular support for baby back supported child carrier according to this invention and in the unfolded (work) position.

FIGS. 2 and 3 are respectively an elevational vertical view of the support shown in the FIG. 1 according to the unfolded (work) position and folded (rest) position.

DETAILED DESCRIPTION OF THE PREFERRED EMBODIMENT

Figure 4:
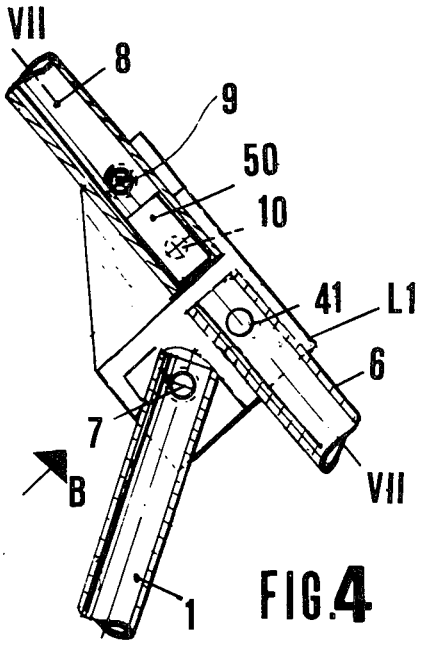
FIGS. 4 and 5 are a sectional view of the particular (A) being the connection box made of plastics in order to show better the position of the said first and second frame with regard to the legs.

The tubular support I for a back supported child carrier Z essentially consists of a first 1 and of a second 8 U-profiled tubular frames as well of two legs **6–6*a* and finally of a prismatic resilient connection box L made of thermoplastic material to be described hereinafter. The two legs 6–6*a* are fastened with one another by a stem-strut 5 as shown in the FIG. 1. The first frame 1 has its ends articulated by means of a rivet 7 to the box L consisting of two specularly symmetric flanges L1–L2. The second frame 8 has its elbow profiled ends articulated to the box by means of the rivet 9. The first and second frame may pivot so as to present an unfolded (FIGS. 1 and 2) and a folded (FIG. 3**) position with regard to the said legs.

Since the two flanges are specularly symmetric C the detailed description of one L1 only will be sufficient.

A first semicylindrical groove 40 housing the end of the leg **6 6*a* is formed in each flange, the rivet 41 operating as a rigid connection means for the two flanges L1-L2. A second and a third intersecting groove 42–42*a* are formed in each flange and extend respectively from the side 43 and 44 of the flanges the portion of the flanges comprised between the grooves 42, 42*a* being profiled as converging inclined planes 45–46. A thin wall 70 is provided with a lateral projecting rim 71, operating as a stop for the frame 8 and formed with a hole 80. The latter is provided only in the flange L1 and its function will be explained hereinafter. It is observed that the thin walls form a fork profiled portion of the box for the free pivoting of the said second frame 8. The rivet 9 forming the pivot of frame 8 of course cooperates to connect with one another the two flanges L1-L2. A lock button is connected to a V-profiled blade spring 50 and freely passes through a hole 11 bored adjacently to the ends of the second frame 8. The spring 50 is inserted into the terminal portion of the said second frame 8**.

OPERATION

Unfolded position: First cadre 1 abuts against the stop shoulder 49 of the two flanges. Second frame 8 is locked in the unfolded (work) position since the two lock buttons 10 engage respectively the hole 80 of the flanges L1.

Figure 5:
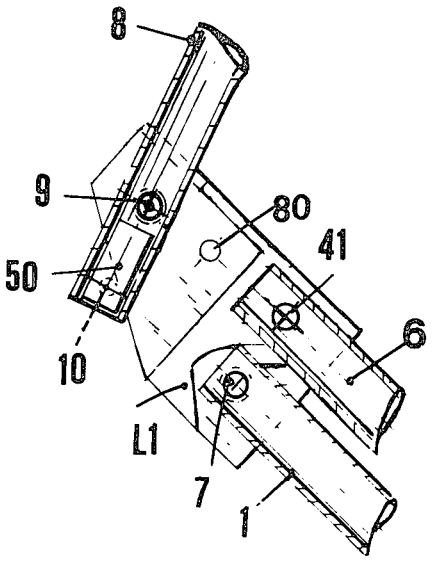
Figure 6:
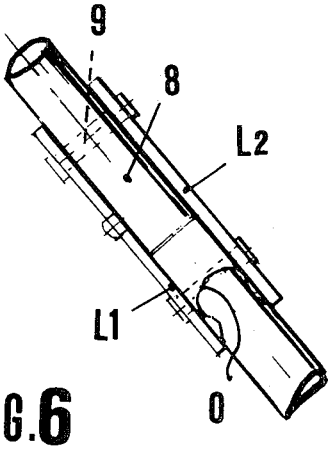
FIG. 6 is an elevational view according to the arrow B of the said connection box.
Figure 7:
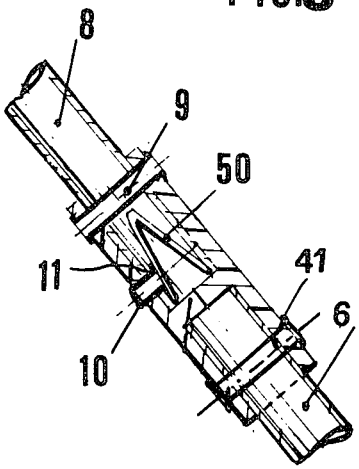
FIG. 7 is a sectional view taken along the lines VII—-VII of the FIG. 4.
Figure 8:
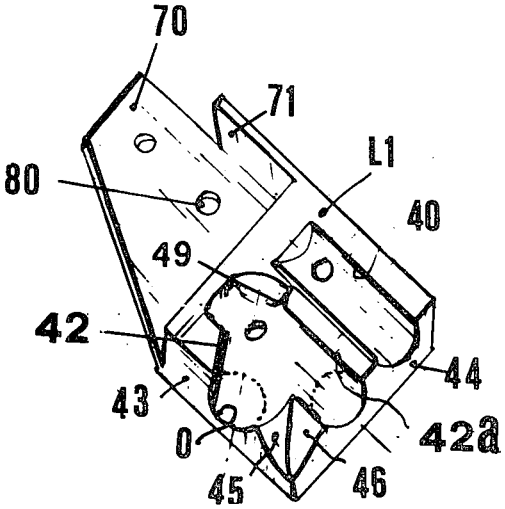
FIG. 8 is a perspective view of one of the two flanges forming the said connection box of plastics material.

Folded position: As soon as the first frame 1 is clockwise (FIGS. 2-4-8) pivoted, the two flanges L1-L2 will be deflected from one another when the ends of frame 1 run upon the inclined surfaces 46 whereby an elastic reaction result. As will be apparent this reaction is caused by the inclined plane profile 0 of the two facing flanges (L1-L2). Such an elastic reaction constitutes too a return elastic force of the two flanges as soon as the ends of the first frame slide upon the opposed inclined surfaces 46. In order to unfasten the second frame 8 it is sufficient to press the lock buttons 10, so as to disengage the same from the holes 80 so that the folded (rest) position of the tubular support I is obtained (see FIGS. 3 and 5).

I claim:

1. A tubular back supported child carrier comprising in combination for each side of the carrier a resilient connection box made of plastics material and including two symmetric flanges, two tubular legs firmly fastened by and located between the said two symmetric flanges of the said box, an upper and a lower U-profiled tubular frame pivotally mounted between the said flanges of the said box so as to be manually displaced in a folded and in an unfolded position, a child supporting bag shaped means fastened between the said upper frame and the said legs, means for supporting the child carrier on a person's back, the said tubular legs being stiffened by a metallic stem operating as a strut, the said upper frame including two terminal portions, resilient detents cooperating with the said terminal portions of the said upper frame so as to removably fasten the upper frame in the unfolded position and when released to provide foldability of the upper frame against the said legs, each flange of the said box being formed with two intersecting grooves of profile complementary respectively to the section of the said upper and lower frame, the portion of the box comprised between the said intersecting grooves being profiled as profiled intersecting planes, whereby during the passage from the said folded to the said unfolded position and viceversa, the said flanges are elastically diverged from one another and thereafter cause a positive elastically contrained location of the said lower frame in said folded respectively unfolded position, the upper frame and the lower frame folding away from the said legs when the carrier is used as a baby chair the upper frame and the lower frame folding against the said legs when the carrier is stored the upper frame folding from the legs and the lower frame folding against the legs when the carrier is used as a baby pack.

* * * * *